US005937956A

United States Patent [19]

Hesse

[11] Patent Number: 5,937,956

[45] Date of Patent: Aug. 17, 1999

[54] RAM BORING MACHINE

[75] Inventor: Alfons Hesse, Lennestadt, Germany

[73] Assignee: Tracto-Technik Paul Schmidt Spezialmaschinen, Lennestadt, Germany

[21] Appl. No.: 08/761,192

[22] Filed: Dec. 6, 1996

[30] Foreign Application Priority Data

Dec. 9, 1995 [DE] Germany ..... 195 46 069
Dec. 27, 1995 [DE] Germany ..... 195 48 835

[51] Int. Cl.[6] ..... E21B 4/14

[52] U.S. Cl. ..... 175/296; 175/297

[58] Field of Search ..... 175/296, 297, 175/417, 418; 173/99, 133

[56] References Cited

U.S. PATENT DOCUMENTS 5,564,510 10/1996 Walter ..... 175/296
5,803,188 9/1998 McInnes ..... 175/296
5,816,342 10/1998 Prater, Jr. et al. ..... 175/296

*Primary Examiner*—William Neuder

[57] ABSTRACT

A ram-boring machine with forward and reverse motion control which comprises a percussion piston that can be axially displaced in a tubular housing, a control tube that is arranged in the housing and controls the forward and reverse motion of the percussion piston by passing over radial control openings in the percussion piston, control edges on the control tube which are guided in the percussion piston in sealed fashion, a compressed air bore that runs into the front end of the control tube, a compressed air bore or compressed air line that runs into an annular chamber between a first control edge and a second control edge, an outlet bore or outlet line that originates in the region between the second control edge and a third control edge and leads to the rear end of the control tube, and control means for selectively charging the compressed air bore or compressed air line or ventilating the outlet bore or outlet line.

7 Claims, 3 Drawing Sheets

RAM BORING MACHINE

FIELD OF THE INVENTION

The invention pertains to a ram-boring machine with forward and reverse motion control which comprises a percussion piston that can be axially displaced in a housing and a control tube that is arranged in the housing and controls the forward and reverse motion of the percussion piston by passing over radial control openings in the percussion piston.

BACKGROUND OF THE INVENTION

Problems arise with such ram-boring machines if they must be removed from a bore after getting stuck or when thrust bores are produced. In this case, it must be ensured that the change-over from forward motion to reverse motion can be easily realized, and that the restarting of the ram-boring machine is ensured. This also applies to instances in which the ram-boring machine has penetrated very far into the ground. In known ram-boring machines, the change-over from forward motion to reverse motion is realized by axially displacing a control tube. If this axial displacement is realized by means of compressed air after releasing a locking mechanism of the control tube, it is possible to change the ram-boring machine from forward motion to reverse motion without having to interrupt the compressed air supply. However, another change-over from reverse motion to forward motion requires an interruption of the compressed air supply because the control tube cannot simply be retracted into its forward motion position due to the high air pressure. However, it is particularly disadvantageous to interrupt the compressed air supply of the ram-boring machine during the change-over because the percussion piston can assume dead center positions in the housing and an automatic restarting from these dead center positions may not be possible. When changing the motion while the compressed air supply is interrupted, the forward and backward motion of the percussion piston is also interrupted, i.e., it is possible that the ram-boring machine cannot be restarted after the change-over.

Another known change-over method utilizes a control sleeve that engages into the percussion piston as well as a coaxial, rotatable control tube that cooperates with the control sleeve and causes the change-over from forward motion to reverse motion. However, this known method requires seals between the housing and the percussion piston, between the percussion piston and the control sleeve, and between the control sleeve and the control tube, i.e., the number of seals that are subjected to wear is relatively high.

SUMMARY OF THE INVENTION

The present invention is based on the objective of developing a simple forward and reverse motion control for ram-boring machines that are preferably driven by compressed air, wherein a change-over from forward motion to reverse motion and vice versa can be realized without having to interrupt the supply of the compressed medium.

According to the invention, this objective is attained in a ram-boring machine of the initially mentioned type with a control method that utilizes control edges on the control tube which are guided in the percussion piston in sealed fashion, a compressed air bore in the control tube which runs into the front end of the control tube, a compressed air bore or compressed air line or compressed air channel that runs into the region between a first control edge and a second control edge, an outlet bore or outlet line that originates in the region between the second control edge and a third control edge and leads to the rear end of the control tube, and control means for selectively charging the compressed air bore or compressed air line or ventilating the outlet bore or outlet line.

The control means may be realized in remote-controlled fashion and mounted directly on the ram-boring machine or arranged outside of the bore produced by the ram-boring machine in the vicinity of the compressed air source. If the compressed air bore in the control tube which runs into the front end of the control tube is charged with compressed air, the compressed air bore that runs into the region between the first control edge and the second control edge is not charged with compressed air, but rather remains shut, and the outlet bore or outlet line that originates at the region between the second control edge and the third control edge and leads to the rear end of the control tube is opened, the ram-boring machine moves forward. In this case, the interior of the percussion piston is charged with compressed air via the compressed air bore that runs into the front end of the control tube and driven forward in the housing until it comes in contact with the percussion tip of the housing. At this time, the radial control opening of the percussion piston is situated in front of the first control edge on the control tube such that compressed air reaches the outer side of the percussion piston via the compressed air bore that runs into the front end of the control tube and the percussion piston is driven back again. The percussion piston moves backward until the radial control opening passes over the second control edge and the compressed air is discharged into the atmosphere from the outer side of the percussion piston via the radial control opening and the outlet bore or outlet line that originates between the second control edge and the third control edge and leads to the rear end of the control tube. Subsequently, the pressure acting upon the interior of the percussion piston predominates and drives the percussion piston forward in the direction toward the percussion tip of the housing.

If the control means charges the compressed air bore or line that runs into the region between the first control edge and the second control edge with compressed air while the outlet bore or line that runs into the region between the second control edge and the third control edge and leads to the rear end of the control tube is closed, compressed air reaches the outer side of the percussion piston once the control openings in the percussion piston have reached the region between the first control edge and the second control edge. This means that the pressure on the outer side of the percussion piston builds up earlier and a motion reversal occurs before the percussion piston comes in contact with the percussion tip. During the reverse motion of the percussion piston, only the outer side of the percussion piston is ventilated once the control edges have passed over the third control edge on the control tube, i.e., the percussion piston comes in contact with the rear end of the machine housing and thus causes the reverse motion. In this case, it is not necessary to interrupt the compressed air supply of the ram-boring machine while the ram-boring machine is changed from forward motion to reverse motion and vice versa, i.e., the ram-boring machine is not stopped during the change-over. Only one additional sealing edge is required on the control tube. This sealing edge can be easily sealed and, except for the percussion piston, no moving parts that are subjected to wear are required on the control tube or the ram-boring machine, respectively.

The control tube may comprise an axial compressed air bore that runs into its front end, one parallel compressed air bore and one outlet bore. Otherwise, the control tube may be realized solidly.

It is also possible to provide the control tube with an axial compressed air bore of relatively large diameter which runs into the front end of the control tube, and to arrange one compressed air tube or hose as well as one outlet tube or hose therein.

In addition, the control tube may also be realized in such a way that it comprises a first coaxial compressed air tube with an opening that runs into its front end as well as a second tube that is arranged concentric to the first tube and has an annular chamber that runs into the region between the first control edge and the second control edge. In this case, an annular outlet chamber that runs into the region between the second control edge and the third control edge is situated between the second tube and the control tube. The bores in the first compressed air tube and the annular chamber between the first compressed air tube and the tube arranged concentric thereto are connected to the compressed air source via the control means, with the annular chamber situated between the second tube and the control tube serving as a compressed air outlet during the forward motion.

BRIEF DESCRIPTION OF THE DRAWINGS

The invention is described in detail below with reference to several embodiments that are illustrated in the drawing. The drawing shows.

DETAILED DESCRIPTION OF THE PREFERRED EMBODIMENTS

Figure 1:
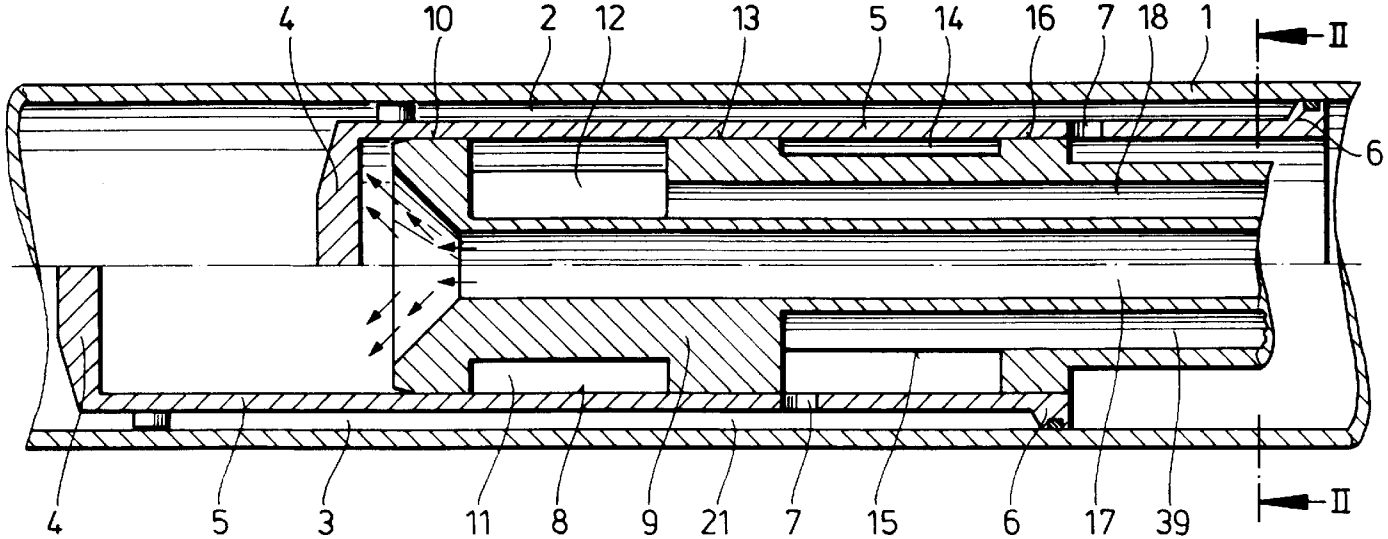
FIG. 1, a partially sectioned representation of a ram-boring machine, wherein the forward motion position is shown in the lower half and the reverse motion position is shown in the upper half.

The tubular housing 1 of the ram-boring machine is only schematically illustrated in FIG. 1. A percussion tip is arranged on the not-shown front end of this housing, with a control tube 9 as well as compressed air lines being arranged on the not-shown rear end of the housing.

The collar 6 of a percussion piston 3 is guided in a bore 2 of the housing 1 in sealed fashion. The percussion piston 3 comprises an end surface 4 that comes in contact with the previously mentioned, not-shown percussion tip during the forward motion of the ram-boring machine. During the reverse motion, the rear end of the percussion piston comes in contact with the rear side of the machine housing. The inner bore 8 of a tube section 5 that connects the end surface 4 to the collar 6 of the percussion piston 3 is guided in sealed fashion on control edges 10,13,16 of the control tube 9. One or more radial bores 7 that connect the interior of the percussion piston 3 to the bore 2 in the housing 1 are arranged in the tube section 5.

Annular chambers 11,14 are situated between the control edges 10,13 and between the control edges 13,16. However, these annular chambers are only required if the piston 3 is not arranged in rotationally rigid fashion relative to the control tube 9 and the openings 7 are not arranged flush with the openings 12,15.

A longitudinal bore 17 that runs into the front end of the control tube 9 and is connected to a not-shown compressed air line extends in the control tube 9. An additional bore 18 that is connected to a compressed air line extends parallel to the bore 17 and runs into the annular chamber 11 via an opening.

One additional parallel bore 39 forms an outlet for the compressed air and runs into the annular chamber 14 via an opening 15.

At least the compressed air bore 18 and the outlet bore 39 are connected to control means that are either realized in remote-controlled fashion and directly mounted on the ram-boring machine or arranged outside the bore produced by the ram-boring machine in the vicinity of a compressed air source and connected to the ram-boring machine via corresponding lines.

If compressed air is only supplied to the bore 17 while the bore 18 remains shut and the outlet bore 39 is opened, the ram-boring machine moves forward as shown in the lower half of FIG. 1. In this case, the interior of the percussion piston 3 and, after the radial bores 7 pass over the control edge 10, the annular chamber 21 between the housing 1 and the percussion piston 3 are exclusively charged with compressed air via the compressed air bore 17 that runs into the front end of the control tube 9. During the reverse motion of the percussion piston, the annular chamber 21 is already ventilated after the lower radial bore 7 passes over the control edge 13 because the compressed air can be discharged toward the outside via the annular chamber 14, the opening 15 and the bore 39.

If the control means charge the bore 18 with compressed air in addition to the bore 17 while the outlet bore 39 remains shut, compressed air already reaches the annular chamber 21 between the housing 1 and the percussion piston 3 once the radial bores 7 have passed over the second control edge 13. The annular chamber 21 is only ventilated once the upper radial bore 7 has passed over the third control edge 16. Consequently, the outer side of the percussion piston 3 is charged with compressed air earlier such that a motion reversal occurs before the end surface 4 comes in contact with the percussion tip. The annular chamber 21 is ventilated later and the rear side of the percussion piston comes in contact with the rear end of the housing bore 2 and causes the reverse motion.

Figure 2:
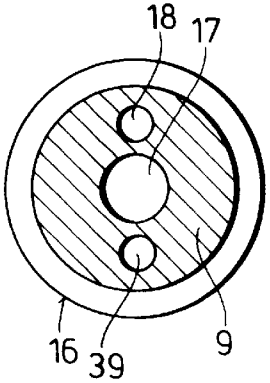
FIG. 2, a sectioned representation of the control tube as seen in the direction of arrows II—II in FIG. 1.
Figure 4:
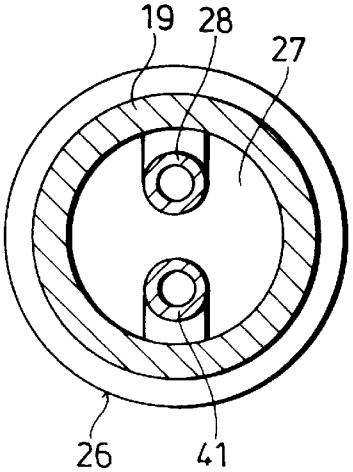
FIG. 4, a cross section through the control tube along line IV—IV in FIG. 3.
Figure 3:
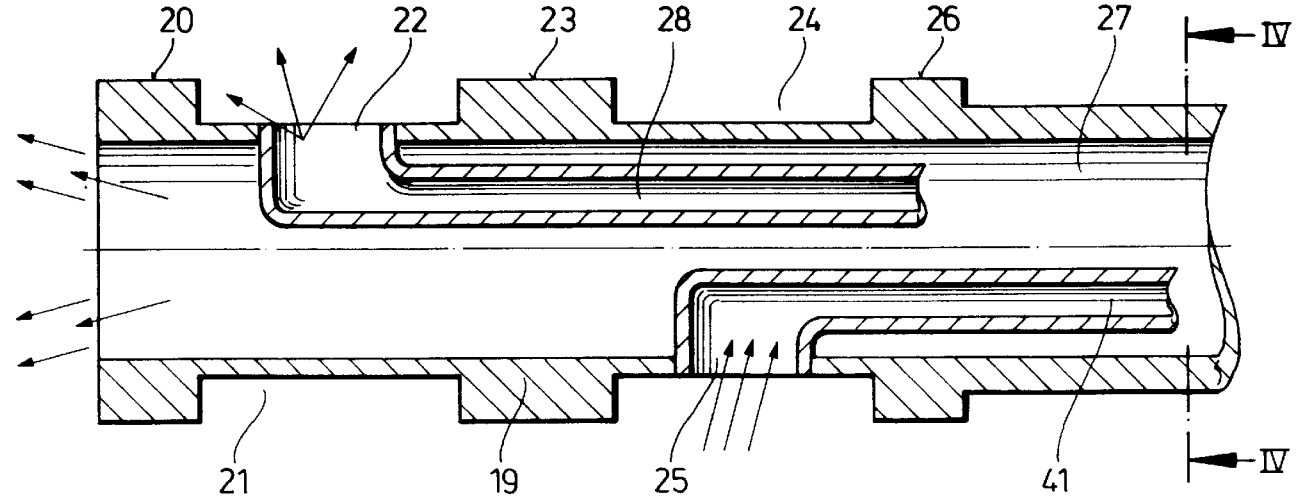
FIG. 3, a partially sectioned representation of a control tube.

The function of the embodiment shown in FIGS. 3 and 4 essentially corresponds to that of the embodiment shown in FIGS. 1 and 2; it merely differs from the embodiment shown in FIGS. 1 and 2 due to the fact that the control tube 19 comprises a bore 27 of relatively large diameter in which a compressed air line 28 and an outlet line 41 that lead to the rear end of the control tube 19 are arranged.

The control tube 19 comprises a first control edge 20, a second control edge 23 and a third control edge 26. Annular chambers 21,24 with openings 22,25 for the compressed air line 28 and the outlet line 41 are respectively situated between the control edges 20, 23 and between the control edges 23,26.

Figure 6:
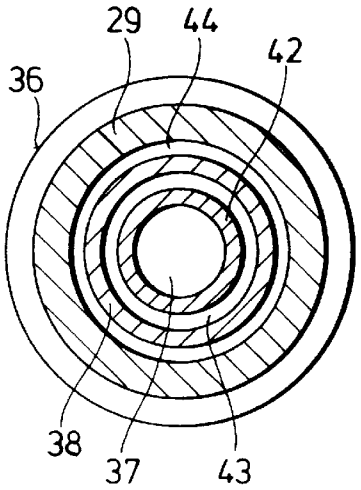
FIG. 6, a cross section through the control tube according to FIG. 5 along line VI—VI.
Figure 5:
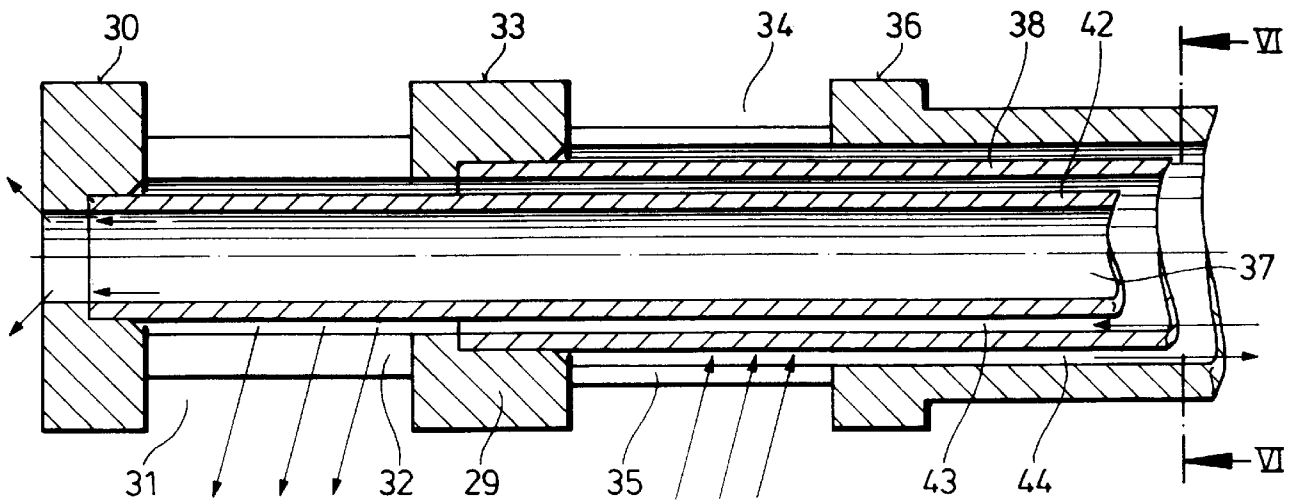
FIG. 5, a partially sectioned representation of another control tube.

The embodiment of a control tube 29 shown in FIGS. 5 and 6 also comprises first, second, and third control edges 30,33 and 36. Annular chambers 31,34 are respectively situated between these control edges. Within the region of these annular chambers 31,34, the control edges 30,33,36 are connected to one another by means of axial webs 32,35. A compressed air bore 42 that runs into the front end of the control tube 29 extends up to the first control edge 30. A line 38 that extends concentric thereto extends up to the region of the second control edge 33, with an annular chamber 43 situated between the line 42 and the line 38 running into the region between the first and the second control edge 30,33 within the region of the annular chamber 31.

One additional annular chamber 44 that runs into the region between the control edges 33,36 within the region of the annular chamber 34 is situated between the line 38 and the control tube 29.

The bore 42 of the tube 37 is continuously charged with compressed air. The annular chamber 43 can be selectively charged with compressed air by means of the not-shown control means if the ram-boring machine moves backward. During the forward motion of the ram-boring machine, the annular chamber 44 serves as an outlet line for the compressed air. However, this annular chamber is closed during the reverse motion of the ram-boring machine by means of the not-shown control means such that the compressed air is discharged from the outer side of the control tube 29 after passing over the control edge 36.

The webs 32,35 shown in FIG. 5 which serve for connecting the control edges 30,33 may also be omitted. In this case, the control edge 30 is arranged on the tube 42, the control edge 33 is arranged on the tube 38 and the control edge 36 is arranged on the control tube 29. The individual control edges may also be connected to the respective lines via an elastic intermediate element.

The control tube may comprise only two or more than three control edges. In addition, more than two or three compressed air lines and outlet lines may be arranged between a corresponding number of control edges in order to control the number of percussions or the piston stroke.

I claim:

1. A ram-boring machine with forward and reverse motion control, comprising:

a percussion piston that can be axially displaced in a housing;

a control tube arranged in the housing and controlling forward and reverse motion of the percussion piston by being passed over by radial control openings in the percussion piston;

control edges in the percussion piston;

a first compressed-air bore running to a front end of the control tube;

a second compressed-air bore running into a chamber between a first control edge and a second control edge;

an outlet bore originating at a chamber between the second control edge and a third control edge and leading to a rear end of the control tube; and control means for selectively charging the second compressed-air bore or ventilating the outlet bore.

2. The ram-boring machine according to claim 1, wherein the control edges are arranged on the control tube.

3. The ram-boring machine according to claim 1, wherein each control edge is connected to a respective concentric tube.

4. The ram-boring machine according to claim 1, wherein the first and second compressed-air bores and the outlet bore are in the control tube.

5. The ram-boring machine according to claim 1, wherein the control tube includes the first compressed-air bore, and wherein the second compressed-air bore and the outlet bore are arranged in the first compressed-air bore.

6. The ram-boring machine according to claim 1, wherein the control tube includes:

a first coaxial compressed-air tube having the first compressed-air bore; and a second coaxial compressed-air tube being concentric with the first coaxial compressed-air tube and having the second compressed-air bore, wherein the outlet bore is formed between the control tube and the second coaxial compressed-air tube.

7. The ram-boring machine according to claim 1, wherein the control means are mounted on the ram-boring machine and are remotely controlled.

* * * * *